United States Patent [19]

Follo

[11] Patent Number: 4,830,374

[45] Date of Patent: May 16, 1989

[54] SIMULATED BASEBALL GAME APPARATUS

[76] Inventor: Thomas A. Follo, 382 Central Ave., New Haven, Conn. 06515

[21] Appl. No.: 20,476

[22] Filed: Mar. 2, 1987

[51] Int. Cl.[4] ..... A63F 7/20

[52] U.S. Cl. ..... 273/89; 273/129 AP

[58] Field of Search ..... 273/88, 89, 90, 93 R, 273/85 A, 85 R, 129 R, 129 AP, 129 T, 129 W, 129 V; 434/401

[56] References Cited

U.S. PATENT DOCUMENTS

| | | | |
|---|---|---|---|
| 1,724,860 | 8/1929 | Stokes | 273/89 |
| 1,990,109 | 2/1935 | Brenner | 273/89 |
| 2,095,046 | 10/1935 | Wilner | 434/401 |
| 2,692,443 | 10/1954 | Milligan | 434/401 |
| 3,355,173 | 11/1967 | Selker | 273/89 |
| 3,709,494 | 1/1973 | Barlow | 273/89 |
| 4,014,108 | 3/1977 | Hester | 434/401 |
| 4,014,543 | 3/1977 | Arad | 273/129 AP |
| 4,179,123 | 12/1979 | Tsukuda | 273/89 |
| 4,216,961 | 8/1980 | McQuillan | 273/89 |

*Primary Examiner*—Richard C. Pinkham
*Assistant Examiner*—William E. Stoll
*Attorney, Agent, or Firm*—Bachman & LaPointe

[57] ABSTRACT

A baseball game apparatus including a simulated baseball diamond fitted with an air jet for projecting a low density ball toward a batting device by which the ball is struck, in the right hand or left hand mode, with various degrees of batting power while the ball is airborne. The batting power is adjusted, within the control unit, by interchangeable gears or handles each having a different length lever arm. The ball is projected toward the batting device by an air jet and lofted through the strike zone by a ramp.

3 Claims, 3 Drawing Sheets

C.F.
R.F.
L.F.
HOME
PITCH
DEFENSE

SIMULATED BASEBALL GAME APPARATUS

BACKGROUND OF THE INVENTION

The present invention relates to games and relates in particular to a baseball game played by a number of players on a simulated miniature baseball diamond supported at the level of a billiard table, card table or the like.

The art is replete with such game devices representative examples of which are disclosed and described in U.S. Pat. Nos. 3,879,037, 4,179,123, and 4,251,074.

The '037 patent shows a miniature diamond arrangement in which a ball is rolled down an incline 12 toward a bat 30. The bat is operated by grasping knob 26 and swinging lever 24 horizontally causing rod 22 (supporting bat 20) to pivot thereby operating the bat.

The '123 patent shows a diamond arrangement in which a ball 27 rolls on the diamond surface toward a bat 6 which is operated by a rack and pinion mechanism.

The '074 patent shows a right hand and left hand batting arrangement in which the ball is mounted on a retractile pin. The ball and poin are accelerated to an abrupt stop whereupon the inertia of the moving ball causes the ball to slip off the pin and proceed toward the batter's box.

SUMMARY OF THE INVENTION

It is an object of the present invention to provide batting means which is operable positively and selectively by individual players permitting each player to choose from a variety of batting power strokes. For example, individual, manually operable instrumentalities are available to each batter permitting him to elect to be a heavy hitter, a weak hitter or an average hitter, as he chooses.

It is a further object of the invention to provide pitching means which lofts the ball so that the ball is airborne when struck by the batter.

A further feature of the invention is to provide positive ball and strike zones which eliminate the judgment factor that normally prevails in a conventional baseball game.

A further feature of the invention is the provision of a single, movable nozzle for a jet of air developed manually by compressing a remotely located pneumatic squeeze bulb for projecting the ball toward the batter's box or for projecting the ball from several defensive positions.

In this arrangement there are individual air lines each having inlet sockets adapted to receive and connect with a movable pneumatic squeeze bulb and each having an outlet socket adapted to receive and connect with the movable air nozzle.

The pneumatic bulb is connected to the particular line that leads to the nozzle location from which a player wishes to project a ball. That is, if a player wishes to project a ball from the pitching mound to the batter's box he inserts the bulb into the inlet socket marked "P" and inserts the air nozzle into the outlet socket at the pitcher's mound and with the ball positioned in front of the nozzle, a squeeze of the bulb will project the bulb. Correspondingly, if a player desires to project a ball from left field to the infield, defensively, he introduces the bulb into the inlet socket marked "L.F." and moves the air nozzle to the left field outlet socket.

Alternatively, the invention featurs an air system for defense having a single inlet socket for the squeeze bulb with air line branches leading to the various defensive positions such as left field, centerfield, right field and home plate.

In this arrangement each defensive outlet includes a normally closed check valve which is opened automatically upon insertion of the movable air nozzle at the outlet socket corresponding to the defensive position from which a player desires to project a ball.

A still further feature of the invention is the provision of apertures in the infield playing surface at the respective bases for receiving a ball returned defensively by the movable nozzle to effect an out.

A further feature of the invention is the provision of removable and reversable base pads which in one position designate an empty base and in the reversed position designate an occupied base. These removable base pads are adapted to be inserted into apertures at each base and remain in place during batting. When a player is attempting a put out at a particular base the base pad for that base is removed; if the player projects the ball into the selected aperture a put out occurs.

The baseball game outfield fence is formed with openings which, by virtue of their location, designate a "single" a "double" or a "triple" when a batted ball enters an opening.

It is a further feature of the invention to provide energy absorbing means such as a pad or cushion beyond the fence so that batted balls amounting to hits do not bounce back on to the playing field but drop into a ball collector means for returning the balls to the region of the batter's box where they are readily accessible for further play.

A baseball game apparatus embracing certain features of the present invention may comprise a ramp means, a batting means and a pitching means for projecting a ball toward said batting means, said ramp means being operable to loft a ball moving along said ramp whereby the ball is airborne when it reaches the region of the batting means.

A batting means embracing certain other features of the invention may comprise individual, manually operable instrumentalities calculated to develop different positive levels of batting power.

Other features and advantages of the present invention will become more apparent from an examination of the succeeding specification when read in conjunction with the appended drawings, in which;

DESCRIPTION OF THE PREFERRED EMBODIMENTS

Figure 1:
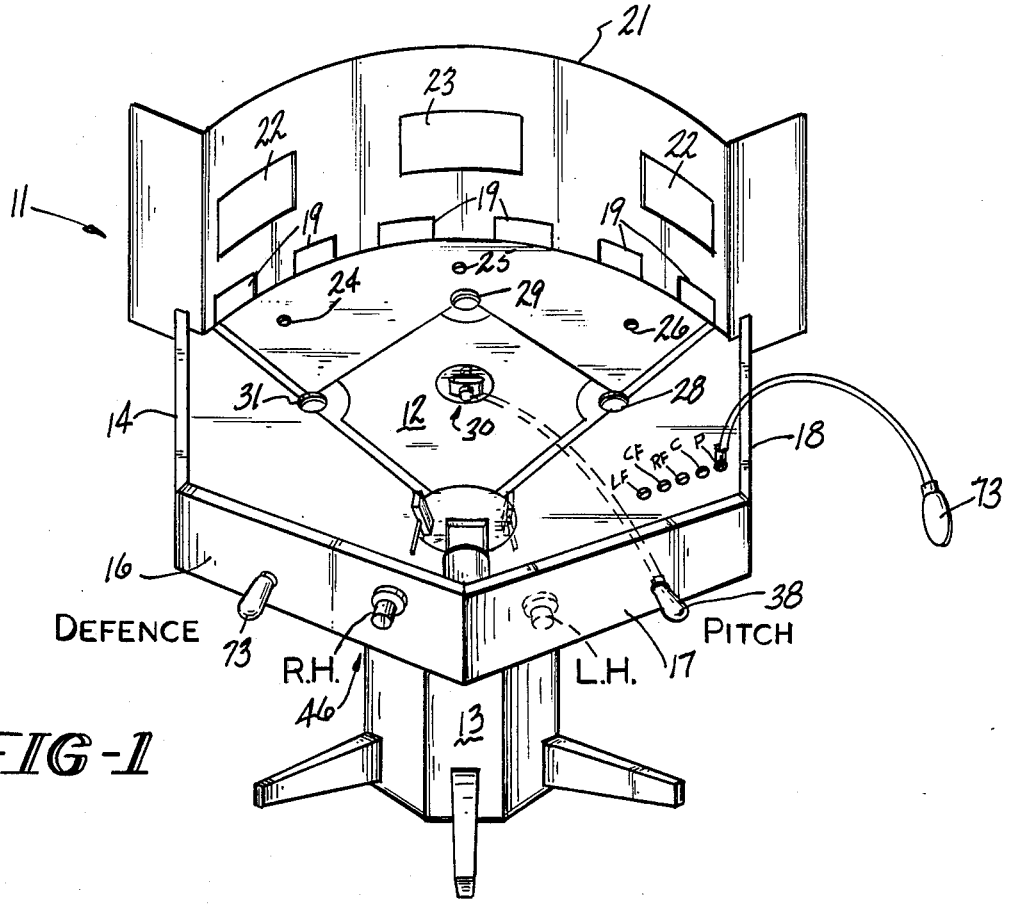
FIG. 1 is a perspective view of the layout of the baseball game apparatus.
Figure 2:
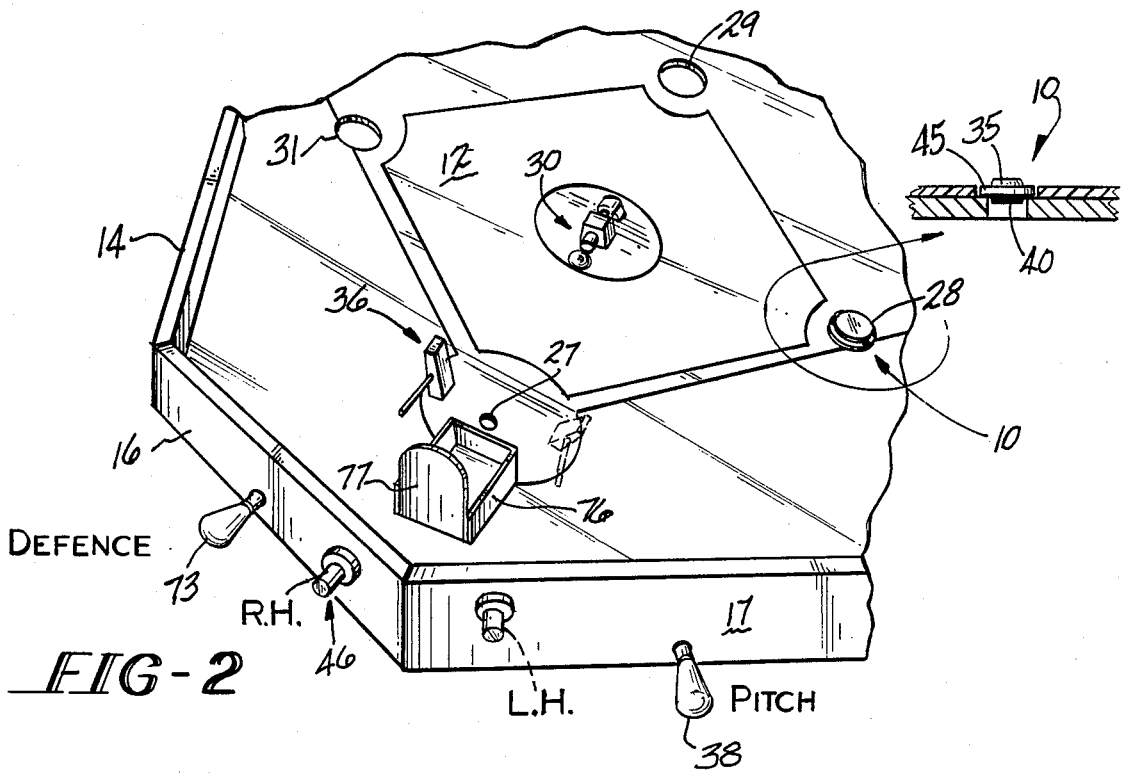
FIG. 2 is a view similar to FIG. 1 with certain portions broken away.

Referring in detail to FIGS. 1 and 2, a baseball game apparatus 11 having a playing surface 12 is supported on a suitable pedestal 13 and is enclosed at the forward region by vertical panels 14, 16, 17, and 18.

The reference numerals 19 in the "fence" 21 designate openings through which a batter must drive a ball to gain a "single"; over the fence 21 is a home run.

The openings 22 define doubles and the opening 23 represents a triple.

The outfield and home plate are formed with small access openings 24, 25, 26, and 27 for locating the moveable ball projector (air nozzle) which will be described in detail as th is specification proceeds.

In the infield, first, second, and third bases and home plate, are formed with large openings 28, 29, 31, and 32 respectively, for receiving a ball returned defensively from the outfield (or from home plate) by the moveable ball projector to effect an out.

During batting the openings 28, 29 and 30 are closed by a base pad device indicated generally by the reference numeral 10 in FIG. 2. The device is reversible and comprises a support disc 45 having a white pad 35 on one side and a black pad 40 on the opposite side.

There is a pad device for each opening 28, 29, and 30. When the white pad 35 is up the base is "empty" and when the black pad 40 is up the base is occupied.

Figure 4:
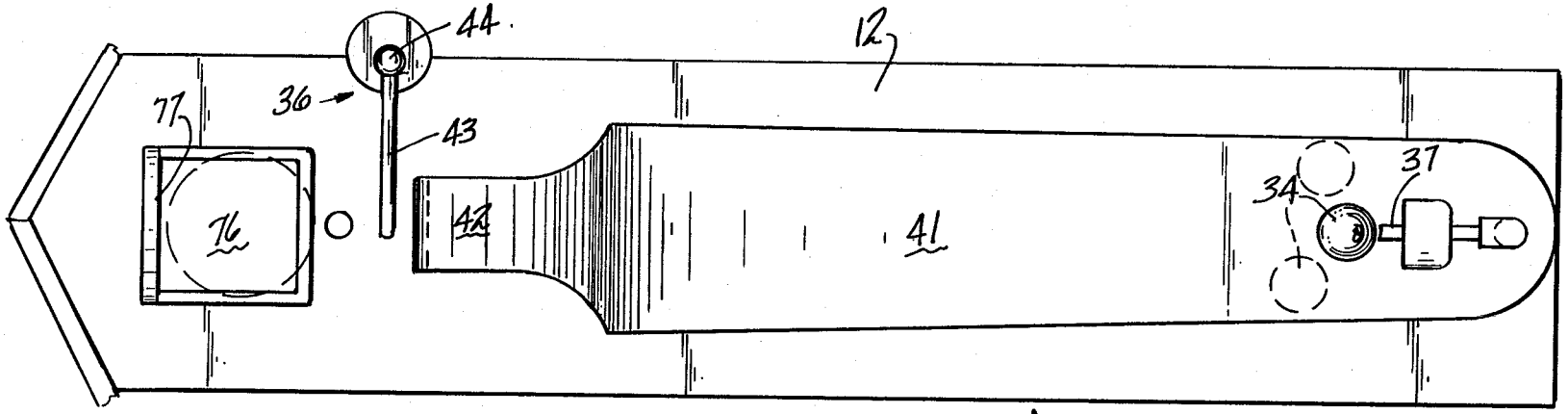
FIGS. 3 and 4 show a side view and a plan view, respectively, of the pitching means, the ramp means and the batting means.
Figure 3:
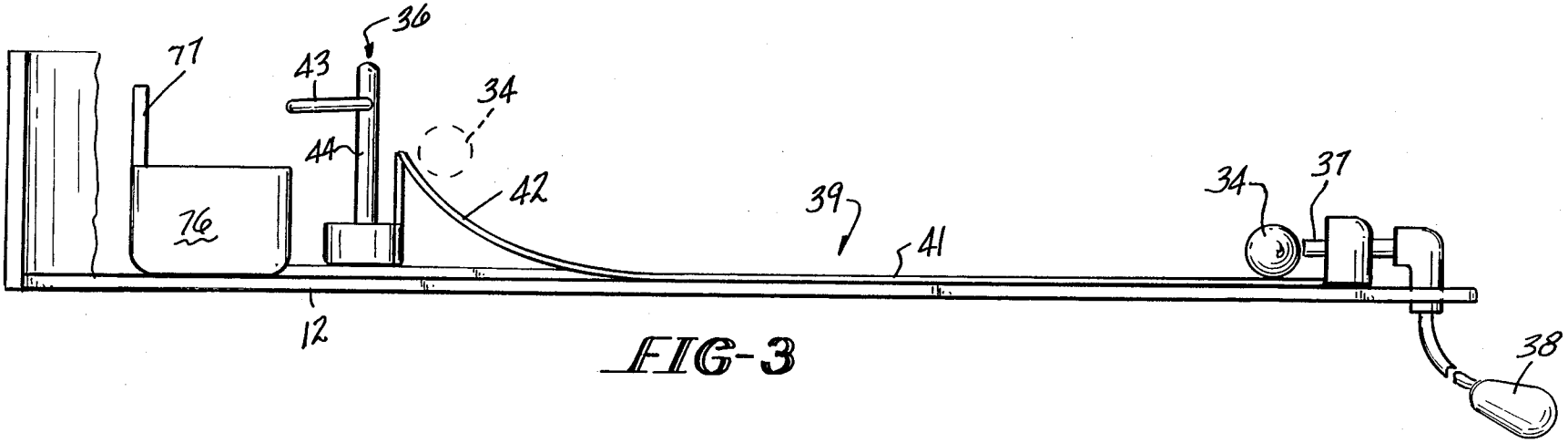

Referring to FIGS. 2, 3 and 4, the pitching means, indicated generally by the reference numeral 30, includes a styrofoam ball 34 projected to the batting means, indicated generally at 36, by an air stream directed through a movable nozzle 37 by the manual manipulation of the compressible pneumatic bulb 38, accessible to a player at the front of the game apparatus as indicated in FIGS. 1 and 2.

The air stream projects the ball 34, from anyone of a number of starting positions as indicated in dotted lines in FIG. 4 along a ramp means 39 defining a generally flat path 41 terminating in an incline 42 rising toward the batting means 36.

The incline 42 is effective to loft the ball as it leaves the incline 42 so that the ball is airborne when it reaches the batter's box.

A bat 43 mounted on pivot pin 44 is operable in the right hand mode as shown in solid lines in FIGS. 1 and 2 or in the left hand mode as shown in dotted lines in FIGS. 1 and 2.

The batting means 36 is operated by individual players at the front of the game apparatus by actuating an operating knob, control means or control unit indicated generally by the reference numeral 46.

There are two embodiments of the batting mechanism each offering to the batter the option to select an operating knob which will generate a distinctive batting or hitting power.

That is, the player can elect to be a heavy hitter, light hitter or average hitter. While three such options are disclosed and described it is entirely within the spirit and scope of the invention to have more than three levels of hitting power.

Figures 5, 6, 7, 8, 9, 10, 11:
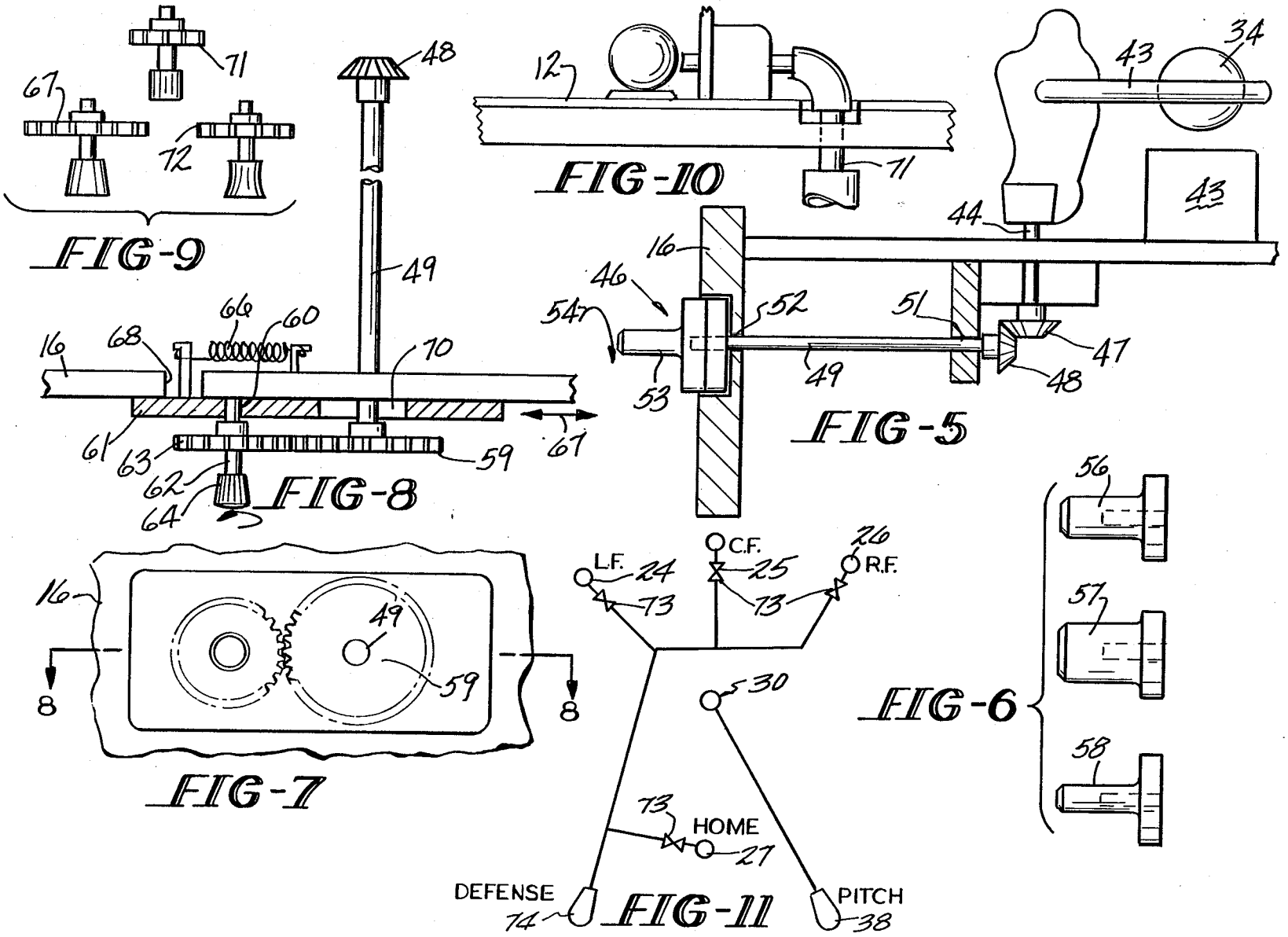
FIG. 5 shows schematically one embodiment of the batting means gear train.
FIG. 6 shows a variety of bat operating knobs each representing a different level of batting power.
FIGS. 7, 8, and 9 show, schematically, an alternative gear arrangement for generating different levels of batting power.
FIG. 10 shows the moveable air jet for pitching and for projecting a batted ball about the infield to attempt a put out.
FIG. 11 shows, schematically, one embodiment of the air tubing layout and check valves for defense with separate tubing for pitching.

FIGS. 5 and 6 show one embodiment of the hitting mechanism in which a pivot pin 44, in the form of a simulated batter, supports a bat 43. The pin 44 terminates in a bevelled gear 47 cooperating with a mating bevel gear 48 fixed to a shaft 49 supported in bearings 51 and 52.

A removable operating knob 53 is splined to the shaft 49 so that manual rotation of the knob 53 in the direction of the arrow 54 causes the bat 43 to swing at the ball 34.

FIG. 6 shows a series of knobs 56, 57, and 58 each of a different diameter, and thus a different radius or lever arm. The mechanism advantage is such that the smaller radius knobs represent strong hitters and the larger radius knobs represent weak hitters.

FIGS. 7, 8, and 9 show an alternative means for effecting variations in hitting power from player to player.

In this arrangement shaft 49 terminates in a gear 59 disposed on the outside of front panel 16. A slide 61 suitably supported in a track (not shown) provides a bearing 6 supporting a stub shaft 62 carrying a gear 63 terminating in a control knob 64.

The slide, biased to the right by coil spring 66, is moveable to and fro, as indicated by the arrow 67 by virtue of clearance slot 68 in the panel 16 and slot 70 in the slide 61 to facilitate changing gears. Here again the gears 69, 71, and 72 (FIG. 9), each of different pitch diameters, vary the hitting power of bat 43 (as they mesh with gear 59) in the same fashion as in the case with the spool knobs of FIGS. 5 and 6.

The balance of the gear train of FIG. 8 beyond bevel gear 47 is the same as in the FIG. 5 arrangement.

For purposes of claiming the invention, the bevel gears 47 and 48 are termed the first gear train and the gears of FIGS. 8 and 9 are termed the second gear train.

When defensive plays are attempted i.e., when the ball is projectedby the movable nozzle from the outfield or from home plate to try for a put out by having the ball enter one or the other of the large openings 28, 29, 31, and 32 at first, second, third and home, respectively. The ramp means 39, the nozzle 37 and the strike receptacle 76 are removed to eliminate obstructions. The nozzle is moved to the particular air outlet (24, 25, 26 or 27) from which it is desired to project the ball to attempt the put out.

FIGS. 10 and 11 show the air system schematically, and the configuration of the moveable nozzle 37 or ball projector which is similar to or the same as the pitching nozzle.

In fact, as stated earlier, a single air nozzle is adequate to operate the game device. That is, the nozzle is movable from the pitchers mound to any one of the defensive positions i.e., left field, center field, right field or home plate and is readily connected to suitable quick operating connectors (not shown) beneath each air outlet 24 through 27.

The connection of the nozzle at home plate is accomplished by removing the strike receptacle 76 (FIGS. 2 and 3).

The tube 71 is inserted into one of the small openings 24, 25, 26, or 27 of the playing field located in left field, centerfield, right field and home plate, respectively, according to the desired defensive play.

In the air distribution system according to the schematic of FIG. 11 insertion of the tube 71 opens a normally closed check valve 73 and actuation of the squeeze bulb 74 from panel 16 will project the ball aimed atone of the large apertures 28, 29, 31, and 32 to effect a put out by having the ball enter the aperture.

Beyond the outfield fence and beyond the openings 19, 22, and 23, corresponding to singles, doubles and triples, an energy absorbing means in the form of a soft pad (not shown) is positioned as a back stop for "hits" to preclude the batted ball from bouncing or ricocheting back onto the playing field.

The result is that the balls drop downwardly where they are propelled mechanically by an air stream about the exterior or under the playing field to a forward point where the balls are accessible and can be retrieved conveniently by the players as the simulated baseball game progresses.

Referring to FIGS. 1, 2, 3, and 4 note that immediately to the rear of the batting means 36 is a receptacle 76 having a backstop 77 for reception of balls missed by the batter.

Should the pitched ball fall into the receptacle 76 it is scored a "strike". Should the ball fall outside the receptacle the call is a "ball".

To provide a left hand batting the devices of the left side (panel 16) are duplicated on the right side (panel 17) of the baseball game apparatus.

An alternative air system is shown schematically in FIG. 1. In this arrangement individual air lines run beneath the playing field to an individual air outlet.

That is, the air inlet labeled LF runs to air outlet 24, air inlet labeled CF runs to air outlet 25, inlet RF runs to outlet 26, inlet H runs to outlet 27 and inlet P runs to the pitching outlet.

Thus, one merely connects the moveable nozzle to the outlet corresponding to the inlet label and upon connecting and squeezing the bulb a ball placed in front of the nozzle is projected.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In a baseball game apparatus having batting facilities, the improvement comprising:

a playing field, a ramp means, a batting means, and a pitching means for projecting a ball toward said ramp means and toward said batting means, said ramp means being operative to loft a ball moving along said ramp means whereby the ball is airborne when it reaches the region of the batting means, said batting means including a manually operable control unit having a plurality of interchangeable rotary elements, each said rotary element being operable individually and selectively to produce a different striking power of the batting means, said batting means including a first gear train and each said rotary element being operable to connect with said first gear train to produce a predetermined ball striking power individual to a given element, said interchangeable rotary elements further defining a plurality of lever means each having a different length lever arm.

2. In a baseball game apparatus having batting facilities, the improvement comprising:

a playing field, a ramp means, a batting means, and a pitching means for projecting a ball toward said ramp means and toward said batting means, said ramp means being operative to loft a ball moving along said ramp means whereby the ball is airborne when it reaches the region of the batting means, said batting means including a manually operable control unit having a plurality of interchangeable rotary elements, each said rotary element being operable individually and selectively to produce a different striking power of the batting means, said batting means including a first gear train and a cooperating second gear train, said second gear train including a first gear means making a driving connection with the first gear train and a second gear means mounted upon a moveable support whereby said second gear means is movable into and out of mesh with said first gear means, said second gear means being mounted removably in a socket formed in said support, said second gear means defining said plurality of interchangeable rotary elements, said second gear means including a plurality of individual gears each of a different diameter and each operable to seat in said socket interchangeably.

3. In a baseball game apparatus having batting facilities, the improvement comprising:

a playing field, a ramp means, a batting means, and a pitching means for projecting a ball toward said ramp means and toward said batting means, said ramp means being operative to loft a ball moving along said ramp means whereby the ball is airborne when it reaches the region of the batting means, said batting means including a manually operable control unit having a plurality of interchangeable rotary elements, each said rotary element being operable individually and selectively to produce a different striking power of the batting means, said batting means including a first gear train and a cooperating second gear train, said second gear train includign a first gear means making a driving connection with the first gear train and a second gear means mounted upon a moveable support whereby said second gear means is movable into and out of mesh with said first gear means, said movable support including biasing means for urging the support and thus the second gear means into mesh with said first gear means, said second gear means defining said plurality of interchangeable rotary elements.

* * * * *